US009471010B2

(12) United States Patent
Fukuta et al.

(10) Patent No.: US 9,471,010 B2
(45) Date of Patent: Oct. 18, 2016

(54) DEVELOPING DEVICE HAVING REGULATING PORTIONS THAT REGULATE MOVEMENT OF A SEAL MEMBER

(71) Applicant: Brother Kogyo Kabushiki Kaisha, Nagoya-shi, Aichi-ken (JP)

(72) Inventors: Hiroya Fukuta, Nagoya (JP); Fan Xu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/317,046

(22) Filed: Jun. 27, 2014

(65) Prior Publication Data

US 2015/0003864 A1 Jan. 1, 2015

(30) Foreign Application Priority Data

Jun. 28, 2013 (JP) ..... 2013-137423

(51) Int. Cl.
*G03G 15/08* (2006.01)

(52) U.S. Cl.
CPC ..... *G03G 15/0898* (2013.01); *G03G 15/0812* (2013.01)

(58) Field of Classification Search
CPC ..... G03G 15/0886; G03G 15/0881; G03G 15/0812; G03G 15/0898
USPC ..... 399/102, 106
See application file for complete search history.

(56) References Cited

U.S. PATENT DOCUMENTS

| | | | | |
|---|---|---|---|---|
| 2010/0092206 | A1 | 4/2010 | Matsushita et al. | |
| 2011/0064454 | A1* | 3/2011 | Xu | G03G 15/0812 399/103 |
| 2011/0255901 | A1 | 10/2011 | Xu et al. | |
| 2013/0028630 | A1 | 1/2013 | Ito et al. | |
| 2013/0028640 | A1* | 1/2013 | Sato et al. | 399/284 |
| 2013/0051866 | A1 | 2/2013 | Itabashi | |
| 2014/0093271 | A1* | 4/2014 | Hoshi | 399/103 |

FOREIGN PATENT DOCUMENTS

| | | | |
|---|---|---|---|
| CN | 201000537 | Y | 1/2008 |
| JP | 2010-091987 | A | 4/2010 |
| JP | 2013-054048 | A | 3/2013 |

* cited by examiner

*Primary Examiner* — Walter L Lindsay, Jr.
*Assistant Examiner* — Philip Marcus T Fadul
(74) *Attorney, Agent, or Firm* — Banner & Witcoff, Ltd.

(57) ABSTRACT

A developing device includes a casing configured to store a developing agent and a developing agent carrier configured to carry the developing agent in the casing. The developing agent carrier is configured to rotate about an axis extending in a first direction. The developing device further includes a layer-thickness regulating member configured to regulate a thickness of a layer of the developing agent carried on the developing agent carrier and a first seal member disposed between the layer-thickness regulating blade and the casing. The first seal member extends along the first direction. The casing includes a first regulating portion configured to regulate a movement of the first seal member in the first direction by contacting a surface of the first seal member non-parallel to the first direction. The first regulating portion may include protrusions and/or indentations to regulate the movement of the first seal member.

40 Claims, 11 Drawing Sheets

DEVELOPING DEVICE HAVING REGULATING PORTIONS THAT REGULATE MOVEMENT OF A SEAL MEMBER

CROSS-REFERENCE TO RELATED APPLICATION

This application claims priority from Japanese Patent Application No. 2013-137423 filed on Jun. 28, 2013, the content of which is incorporated herein by reference in its entirety.

BACKGROUND

1. Technical Field

The disclosure relates to a developing device configured to be mounted or installed in an electrophotographic image forming apparatus.

2. Description of Related Art

A known electrophotographic image forming apparatus includes a photosensitive drum configured to carry an electrostatic latent image and a developing cartridge configured to supply toner to the photosensitive drum.

The developing cartridge includes, for example, a developing case configured to store toner, a developing roller configured to carry the toner, and a layer-thickness regulating blade configured to regulate the thickness of a toner layer on a surface of the developing roller to a constant thickness.

The developing cartridge includes a blade rear seal disposed between the developing case and the layer-thickness regulating blade. The blade rear seal is configured to prevent or reduce the leakage of the toner from a portion between the developing case and the layer-thickness regulating blade.

In the developing cartridge, the blade rear seal includes an elastic layer, e.g., sponge, and a double-sided tape layer. The blade rear seal is attached to the developing case with the double-sided tape layer.

When the blade rear seal is mistakenly attached to a position where it is not intended, it can be difficult to correct the position of the attached blade rear seal. Attachment of the blade rear seal to the developing case may sometimes be difficult or troublesome. The potential for misalignment between the blade rear seal and the developing case increases with the length of the blade rear seal.

SUMMARY

The disclosure relates to a developing device in which a first seal member may be readily attached to a casing of the developing device.

According to one aspect of the disclosure, a developing device may include a casing configured to store a developing agent and a developing agent carrier configured to carry the developing agent in the casing. The developing agent carrier is configured to rotate about an axis extending in a first direction. The developing device further comprises a layer-thickness regulating member configured to regulate a thickness of a layer of the developing agent carried on the developing agent carrier and a first seal member disposed between the layer-thickness regulating blade and the casing. The first seal member extends along the first direction. The casing may include a first regulating portion configured to regulate a movement of the first seal member in the first direction by contacting a surface of the first seal member perpendicular to the first direction. The first regulating portion may include protrusions and/or indentations to regulate the movement of the first seal member. These and other aspects are described herein.

BRIEF DESCRIPTION OF THE DRAWINGS

For a more complete understanding of the disclosure, needs satisfied thereby, and the objects, features, and advantages thereof, reference now is made to the following descriptions taken in connection with the accompanying drawing.

DETAILED DESCRIPTION OF EMBODIMENTS OF THE INVENTION

Figure 1:
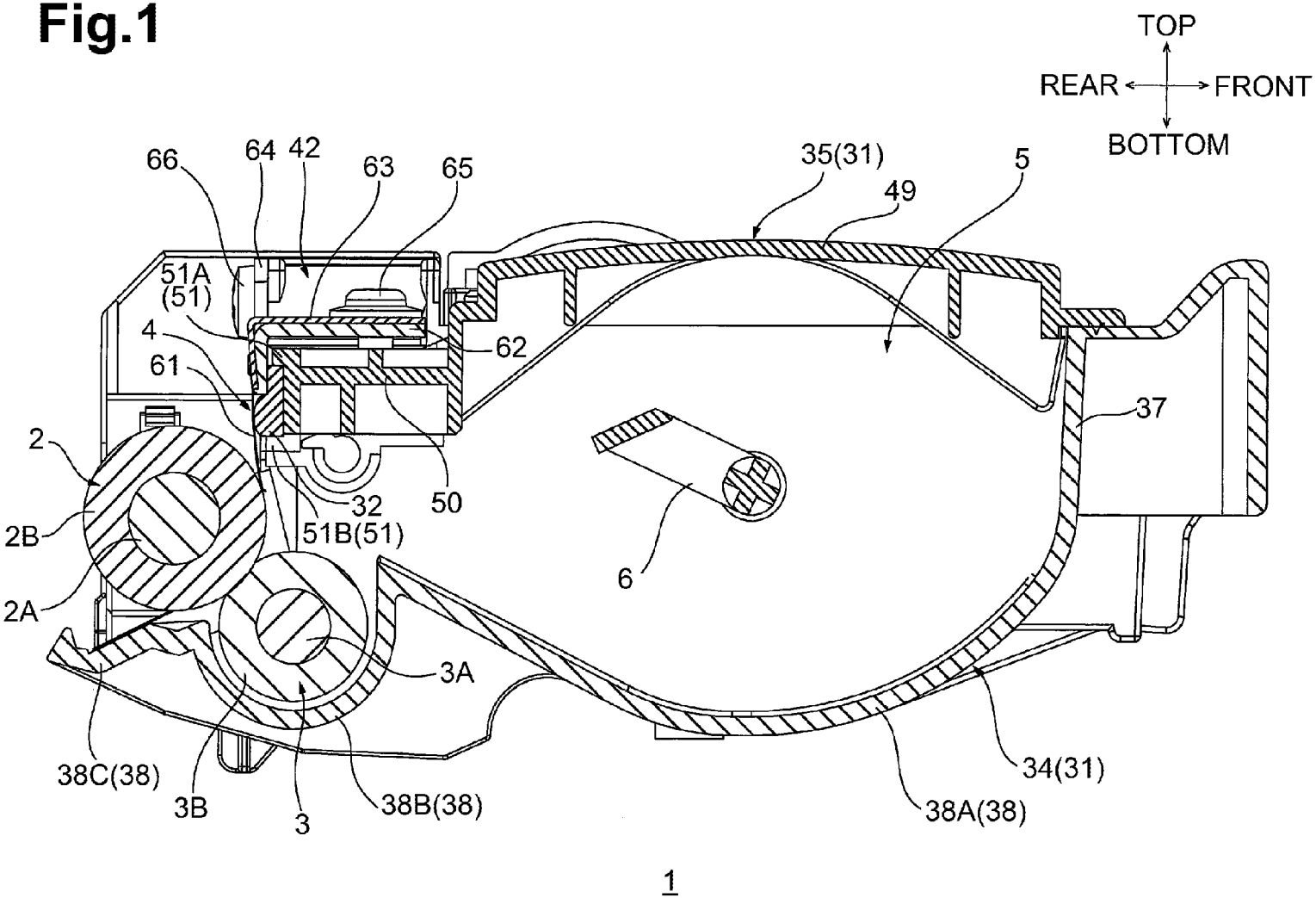
FIG. 1 is a side sectional view of a developing cartridge in an illustrative embodiment according to one or more aspects of the disclosure.

An illustrative embodiment is described in detail herein with reference to the accompanying drawings, like reference numerals being used for like corresponding parts in the various drawings.

1. Outline of Developing Cartridge

As depicted in FIG. 1, a developing device, e.g., a developing cartridge 1, may comprise a developing agent carrier, e.g., a developing roller 2, a supply roller 3, a layer-thickness regulating member, e.g., a layer-thickness regulating blade 4, and a developing frame 31 comprising a toner chamber 5.

In the following description, a top-bottom direction, e.g., a vertical direction, of the developing cartridge 1 may be defined in conjunction with an orientation in which the developing cartridge 1 is placed in a horizontal plane. More specifically, the top or upper side and the bottom or lower side in the sheet of FIG. 1 may be defined as the top or upper side and the bottom or lower side of the developing cartridge 1, respectively. The right side and left side in the sheet of FIG. 1 may be defined as the front side and rear side of the developing cartridge 1, respectively. The left-right direction of the developing cartridge 1 may be determined when the developing cartridge 1 is viewed from the front side. More specifically, the front or near side and the back side of the sheet of FIG. 1 may be defined as the left side and the right side of the developing cartridge 1, respectively. The left-right direction may be an example of a first direction. The front-rear direction may be an example of a second direction. The top-bottom direction may be an example of a third direction.

The developing roller 2 may be rotatably supported in a rear end portion of the developing cartridge 1 to rotate counterclockwise in left side view. The developing roller 2 may comprise a developing roller shaft 2A and a developing roller body 2B.

The developing roller shaft 2A may have a generally cylindrical shape. The developing roller shaft 2A may extend in the left-right direction. In other words, an axis of the developing roller shaft 2A may extend in the left-right direction. The developing roller shaft 2A may comprise metal. Each end portion of the developing roller shaft 2A in the left-right direction may be inserted into a developing roller shaft insertion opening 43 of the developing frame 31.

The developing roller body 2B may have a generally tubular shape. The developing roller body 2B may extend in the left-right direction. The developing roller body 2B may comprise rubber having conductivity. The developing roller body 2B may cover a generally central portion of the developing roller shaft 2A in the left-right direction, without covering each left and right end portion of the developing roller shaft 2A.

The supply roller 3 may be disposed at a front lower portion of the developing roller 2. The supply roller 3 may be supported in the developing cartridge 1 to rotate counterclockwise in left side view. The supply roller 3 may comprise a supply roller shaft 3A and a supply roller body 3B.

The supply roller shaft 3A may have a generally cylindrical shape. The supply roller shaft 3A may extend in the left-right direction. The supply roller shaft 3A may comprise metal. Each end portion of the supply roller shaft 3A in the left-right direction may be inserted into a supply roller shaft insertion opening 30A of a shaft seal 30 (described below).

The supply roller body 3B may have a generally tubular shape. The supply roller body 3B may extend in the left-right direction. The supply roller body 3B may comprise sponge having conductivity. The supply roller body 3B may cover a generally central portion of the supply roller shaft 3A in the left-right direction, without covering each left and right end portion of the supply roller shaft 3A. The supply roller body 3B may contact a front lower end of the developing roller body 2B.

The layer-thickness regulating blade 4 may be disposed at a front upper portion of the developing roller 2. The layer-thickness regulating blade 4 may contact a front end of the developing roller 2.

The toner chamber 5 may be disposed in front of the supply roller 3 and the layer-thickness regulating blade 4. The toner chamber 5 may be configured to store developing agent, e.g., toner. The toner chamber 5 may comprise an agitator 6.

The agitator 6 may be rotatably supported in the toner chamber 5.

2. Usage of Developing Cartridge

Figure 2:
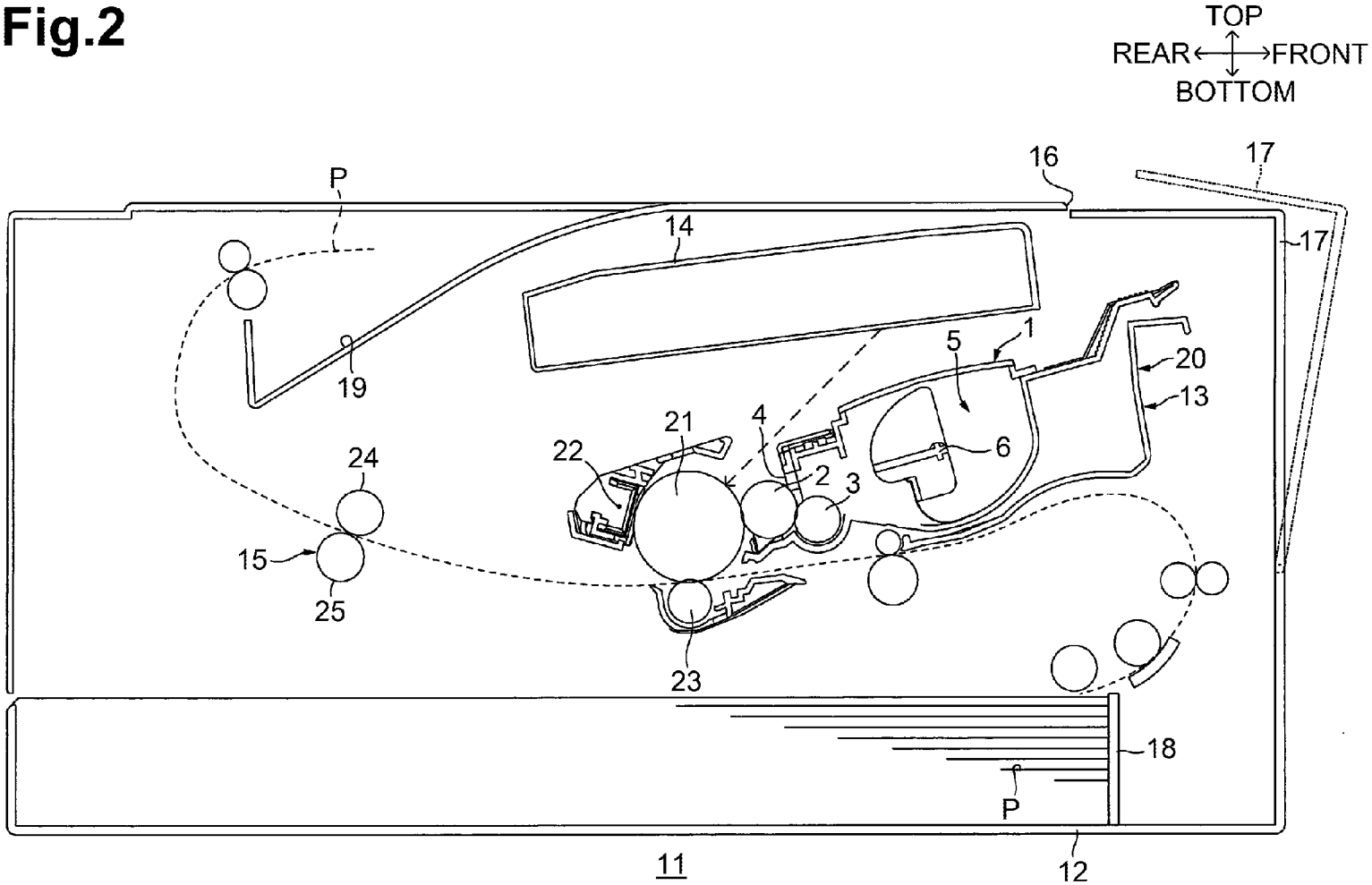
FIG. 2 is a side sectional view of an image forming apparatus to which the developing cartridge depicted in FIG. 1 is to be installed.

As depicted in FIG. 2, the developing cartridge 1 may be used by mounting the developing cartridge 1 to the image forming apparatus 11.

The image forming apparatus 11 may be an electrophotographic monochrome printer. The image forming apparatus 11 may comprise a main casing 12, a process cartridge 13, a scanner unit 14, and a fixing unit 15.

The main casing 12 may comprise a front wall, a rear wall, an upper wall, a bottom wall, and side walls. The main casing 12 may have a generally box shape. The main casing 12 may comprise an opening 16, a front cover 17, a sheet supply tray 18, and a sheet discharge tray 19.

The opening 16 may be disposed at a front end portion of the main casing 12. The opening 16 may be provided to allow an interior and an exterior of the main casing 12 to communicate with each other in the front-rear direction. The opening 16 may permit the process cartridge 13 to pass therethrough.

The front cover 17 may be disposed at a front end portion of the main casing 12. The front cover 17 may have a generally flat plate shape. The front cover 17 may extend in the top-bottom direction. The front cover 17 may be pivotally supported about a lower end portion thereof by the front wall of the main casing 12. The front cover 17 may be configured to open or close the opening 16.

The sheet supply tray 18 may be disposed at a bottom portion of the main casing 12. The sheet supply tray 18 may be configured to accommodate one or more sheets P.

The sheet discharge tray 19 may be disposed at a middle portion of the upper wall of the main casing 12 in the front-rear direction. The sheet discharge tray 19 may be depressed downward from an upper surface of the main casing 12 to receive the sheets P.

The process cartridge 13 may be accommodated in a generally central portion of the main casing 12 in the top-bottom direction. The process cartridge 13 may be configured to be attached to or removed from the main casing 12. The process cartridge 13 may comprise a drum cartridge 20 and the developing cartridge 1.

The drum cartridge 20 may comprise a photosensitive drum 21, a scorotron charger 22, and a transfer roller 23.

The photosensitive drum 21 may be rotatably supported at a rear end portion of the drum cartridge 20.

The scorotron charger 22 may be disposed behind the photosensitive drum 21 with a distance between the scorotron charger 22 and the photosensitive drum 21.

The transfer roller 23 may be disposed below the photosensitive drum 21. The transfer roller 23 may contact a lower end of the photosensitive drum 21.

The developing cartridge 1 may be configured to be attached to the drum cartridge 20 in front of the photosensitive drum 21, such that the developing roller 2 may contact a front lower end of the photosensitive drum 21.

The scanner unit 14 may be disposed above the process cartridge 13. The scanner unit 14 may be configured to emit laser beam toward the photosensitive drum 21 based on image data.

The fixing unit 15 may be disposed behind the process cartridge 13. The fixing unit 15 may comprise a heat roller 24 and a pressure roller 25 that may be pressed against a rear upper end of the heat roller 24.

When the image forming apparatus 11 starts an image forming operation, the scorotron charger 22 may uniformly change a surface of the photosensitive drum 21. The scanner unit 14 may expose the surface of the photosensitive drum 21 with light. Thus, an electrostatic latent image based on image data may be formed on the surface of the photosensitive drum 21.

The agitator 6 may agitate the toner in the toner chamber 5, and supply the toner to the supply roller 3. The supply roller 3 may supply the toner supplied by the agitator 6 to the developing roller 2. At this time, the toner may be positively charged between the developing roller 2 and the supply roller 3 by friction, and be carried on the developing roller 2. The layer-thickness regulating blade 4 may regulate the thickness of the toner layer carried on the developing roller 2 to a constant thickness.

Then, the toner carried on the developing roller 2 may be supplied to the electrostatic latent image on the surface of the photosensitive drum 21. Thus, a toner image may be carried on the surface of the photosensitive drum 21.

The sheets P may be supplied one by one between the photosensitive drum 21 and the transfer roller 23 from the sheet supply tray 18 at a predetermined timing, with the rotation of various rollers. The toner image on the surface of the photosensitive drum 21 may be transferred to the sheet P when the sheet P passes between the photosensitive drum 21 and the transfer roller 23.

Thereafter, when the sheet P passes between the heat roller 24 and the pressure roller 25, heat and pressure may be applied to the sheet P. Thus, the toner image on the sheet P may be thermally fixed on the sheet P. Thereafter, the sheet P may be discharged onto the sheet discharge tray 19.

3. Details of Developing Cartridge (1) Structure of Developing Cartridge

Figure 3:
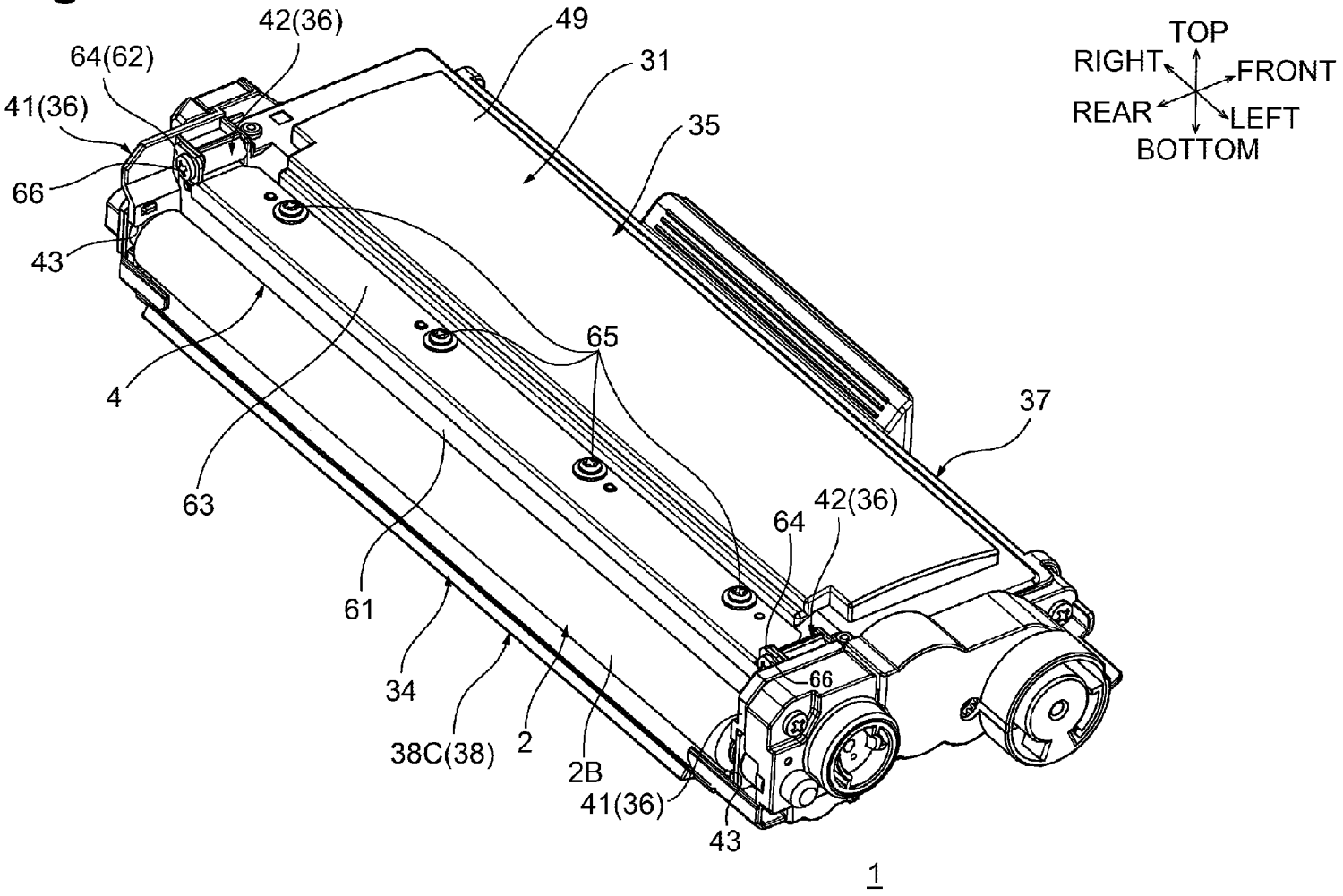
FIG. 3 is a perspective view of the developing cartridge depicted in FIG. 2 viewed from an upper rear side thereof.
Figure 4:
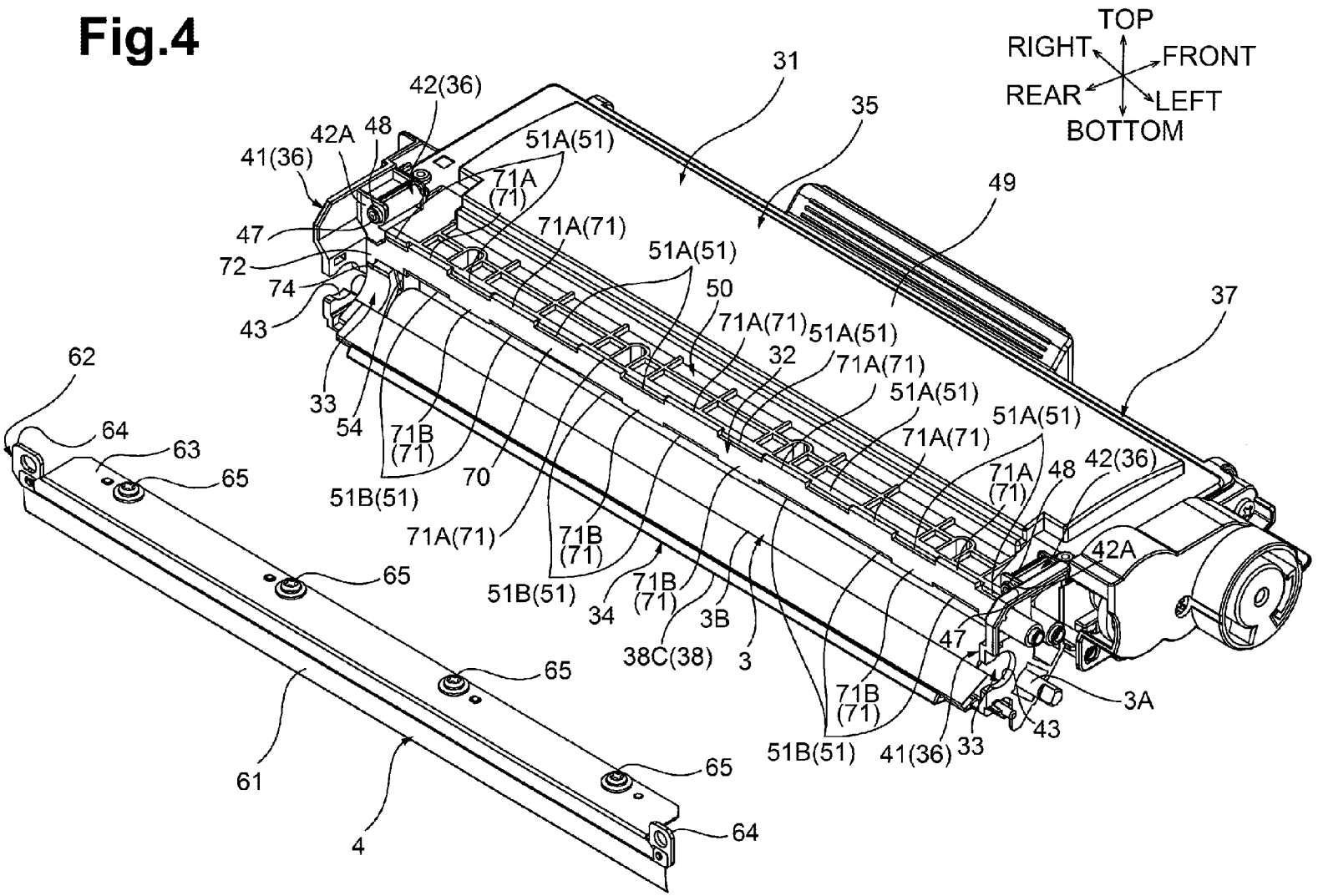
FIG. 4 is an exploded perspective view of the developing cartridge depicted in FIG. 3 viewed from an upper rear side thereof, in which a developing roller and a layer-thickness regulating blade of the developing cartridge are detached, and the developing roller is omitted in FIG. 4.

As depicted in FIGS. 3 and 4, the developing cartridge 1 may comprise a casing, e.g., the developing frame 31, the layer-thickness regulating blade 4, a first seal member, e.g., a blade seal 32, and a second seal member, e.g., two side seals 33.

(1-1) Developing Frame

The developing frame 31 may have general a box shape. A rear end portion of the developing frame 31 may be open. The developing frame 31 may comprise a base frame 34 and a cover frame 35.

Figure 6:
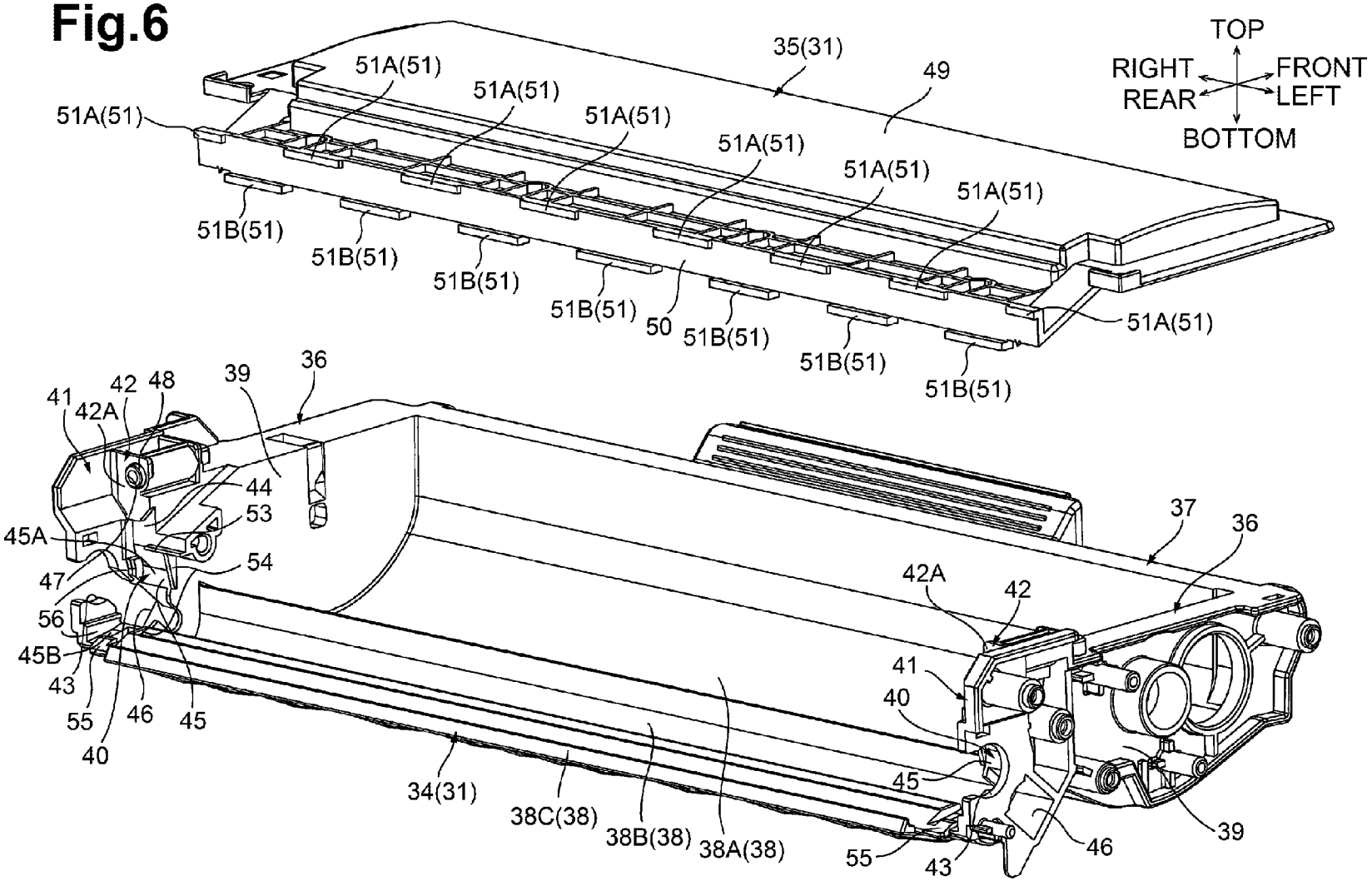
FIG. 6 is an exploded perspective view of a developing frame of the developing cartridge depicted in FIG. 5.

As depicted in FIG. 6, the base frame 34 may have a bottomed frame shape. The base frame 34 may be integrally provided with a pair of side walls 36, a front wall 37, and a bottom wall 38.

Each side wall 36 may be disposed at each end portion of the base frame 34 in the left-right direction. Each side wall 36 may comprise a body 39, a seal support portion 40, a first regulating portion and an outward regulating portion (for example, both being represented by a developing roller attachment portion 41), and a blade attachment portion 42.

The body 39 may comprise a front half portion of the side walls 36. The body 39 may have a generally rectangular flat plate shape in side view. The body 39 may extend in the front-rear direction.

The seal support portion 40 may protrude outward in the left-right direction from a rear end portion of the body 39, and may extend in the top-bottom direction. The seal support portion 40 may comprise a blade seal support portion 44, a side seal support portion 45, and a shaft seal support portion 46.

The blade seal support portion 44 may be disposed at an upper end portion of the seal support portion 40. The blade seal support portion 44 may have a generally rectangular shape in front view. The blade seal support portion 44 may comprise a first positioning portion 53.

The first positioning portion 53 may be disposed at a lower end portion of the blade seal support portion 44. The first positioning portion 53 may protrude rearward from a rear surface of the blade seal support portion 44, and may extend in the left-right direction. An outward end portion of the first positioning portion 53 in the left-right direction may be positioned inward of the developing roller attachment portion 41 in the left-right direction with a distance from the developing roller attachment portion 41.

The side seal support portion 45 may be disposed below the blade seal support portion 44. The side seal support portion 45 may comprise a first support portion 45A, a curve portion, and a second support portion 45B. The first support portion 45A of the side seal support portion 45 may extend downward continuously from a lower end portion of the blade seal support portion 44. The curve portion of the side seal support portion 45 may continue from the first support portion 45A. The curve portion may extend downward while curving along a front lower end of the developing roller body 2B. The curve portion may be open. The second support portion 45B may continue from the curve portion and extend rearward. The side seal support portion 45 may comprise a second positioning portion 54, a third positioning portion 55, and a fourth positioning portion 56.

The second positioning portion 54 may be disposed inward of the first support portion 45A and the second support portion 45B of the side seal support portion 45 in the left-right direction. The second positioning portion 54 may have a generally flat plate shape. The second positioning portion 54 may protrude rearward from inner ends of the first support portion 45A and the second support portion 45B in the left-right direction, and may extend in the top-bottom direction. An upper end portion of the second positioning portion 54 may continue to a generally central portion of the first positioning portion 53 in the left-right direction.

The third positioning portion 55 may be disposed at a rear end portion of the side seal support portion 45. The third positioning portion 55 may protrude upward from a generally central portion of the side seal support portion 45 in the left-right direction. The third positioning portion 55 may have a generally rectangular shape in plan view.

The fourth positioning portion 56 may be disposed outward of the first support portion 45A and the second support portion 45B in the left-right direction. The fourth positioning portion 56 may have a generally rectangular flat plate shape in side view. The fourth positioning portion 56 may protrude rearward from outer ends of the first support portion 45A and the second support portion 45B in the left-right direction, and may extend in the top-bottom direction. An outer end portion of the fourth positioning portion 56 in the left-right direction may continue to an inner surface of the developing roller attachment portion 41 in the left-right direction.

Figure 9A:
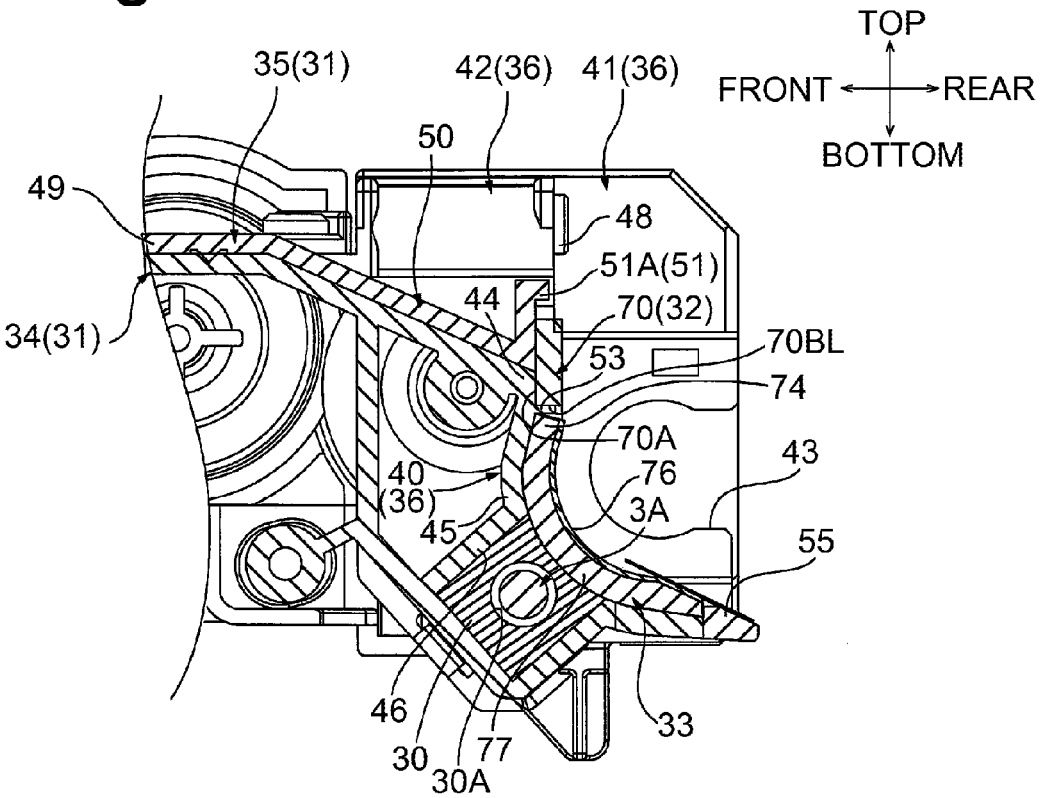
FIG. 9A is a sectional view of the developing cartridge taken along the line A-A of FIG. 8.

The shaft seal support portion 46 may be disposed between the first support portion 45A and the second support portion 45B in a rotating direction of the developing roller 2. More specifically, the shaft seal support portion 46 may extend forward and downward from an upstream end of the first support portion 45A in the rotating direction of the developing roller 2 and a downstream end of the second support portion 45B in the rotating direction of the developing roller 2. The shaft seal support portion 46 may have a generally square tubular shape. The shaft seal support portion 46 may open in each end portion thereof in the left-right direction. The shaft seal support portion 46 may be configured to support the shaft seal 30, as depicted in FIG. 9A.

The shaft seal 30 may have a generally prism shape. The shaft seal 30 may extend in the left-right direction. The shaft seal 30 may comprise an elastic member, e.g., sponge. The shaft seal 30 may have a supply roller shaft insertion opening 30A.

The supply roller shaft insertion opening 30A may be disposed at a generally central portion of the shaft seal 30 in side view. The supply roller shaft insertion opening 30A may have a generally circular shape in side view. The supply roller shaft insertion opening 30A may pass through the shaft seal 30 in the left-right direction. The rear surface of the shaft seal 30 may have a generally in a shape of an arc, in side view, that may extend along the peripheral surface of the developing roller body 2B. The rear surface of the shaft seal 30 may be generally flush with the rear surface of the side seal support portion 45.

The developing roller attachment portion 41 may extend rearward from an outer end portion of the seal support portion 40 in the left-right direction, as depicted in FIG. 6. The developing roller attachment portion 41 may have a generally rectangular flat plate shape in side view. The developing roller attachment portion 41 may have the developing roller shaft insertion opening 43.

The developing roller shaft insertion opening 43 may be disposed at a rear end portion of the developing roller attachment portion 41. The developing roller shaft insertion opening 43 may have a generally circular shape in side view with a rear end portion thereof open. The developing roller shaft insertion opening 43 may pass through the developing roller attachment portion 41 in the left-right direction. The inside diameter of the developing roller shaft insertion opening 43 may be greater than the diameter of the developing roller shaft 2A of the developing roller 2.

The blade attachment portion 42 may protrude upward continuously from an upper rear end portion of the body 39. The blade attachment portion 42 may have a generally prism shape. The blade attachment portion 42 may extend in the front-rear direction. A rear surface 42A of the blade attachment portion 42 may continue to the rear surface of the body 39 and may extend in the top-bottom direction. The blade attachment portion 42 may comprise a screw hole 47 and a boss 48.

The screw hole 47 may be disposed at an upper end portion of the blade attachment portion 42. The screw hole 47 may be recessed from the rear surface 42A of the blade attachment portion 42 toward the front side. The screw hole 47 may have a generally circular shape in front view.

The boss 48 may protrude rearward from the peripheral edge of the screw hole 47. The boss 48 may have a generally tubular shape.

The bottom wall 38 may be integrally provided with a first portion 38A, a second portion 38B, and a third portion 38C, as depicted in FIGS. 1 and 6.

The first portion 38A may be disposed at a front half portion of the base frame 34. The first portion 38A may have a generally arc shape in sectional view. A generally central portion of the first portion 38A in the front-rear direction may be depressed downward. Each left and right end portions of the first portion 38A may continue to a lower end portion of the body 39 of the relevant side wall 36. The first portion 38A may constitute the bottom wall of the toner chamber 5.

The second portion 38B may be disposed behind the first portion 38A. The second portion 38B may have a generally arc shape in sectional view. The second portion 38B may continue to a rear end portion of the first portion 38A and may extend rearward while curving, along an outer peripheral surface of the supply roller 3. Each left and right end portions of the second portion 38B may continue to a lower end portion of the shaft seal support portion 46 of the relevant side wall 36.

The third portion 38C may be disposed behind the second portion 38B. The third portion 38C may have a generally linear shape in sectional view. The third portion 38C may continue to a rear end portion of the second portion 38B and may extend rearward. Each left and right end portion of the third portion 38C may continue to the respective second support portion 45B of the side walls 36 in the left-right direction.

The front wall 37 may continue to a front end portion of the bottom wall 38 and may extend upward. The front wall 37 may have a generally rectangular shape in front view. Each left and right end portion of the front wall 37 may continue to a front end portion of the body 39 of the relevant side wall 36.

The cover frame 35 may be disposed above the base frame 34. The cover frame 35 may be integrally provided with a cover portion 49 and a blade seal support portion 50.

The cover portion 49 may have a generally rectangular flat plate shape in plan view. A front end portion of the cover portion 49 may be welded to an upper end portion of the front wall 37 of the base frame 34. Each left and right end portion of the cover portion 49 may be welded to an upper end portion of the relevant side wall 36 of the base frame 34.

The blade seal support portion 50 may be disposed behind the cover portion 49 between rear end portions of the side walls 36 of the base frame 34. The blade seal support portion 50 may have a generally rectangular flat plate shape in plan view. The blade seal support portion 50 may continue from a rear end portion of the cover portion 49 and may extend rearward. Each left and right end portion of the blade seal support portion 50 may be welded to the relevant side walls 36 of the base frame 34. The blade seal support portion 50 may comprise a plurality of second regulating portions, e.g., ribs 51.

Figure 7:
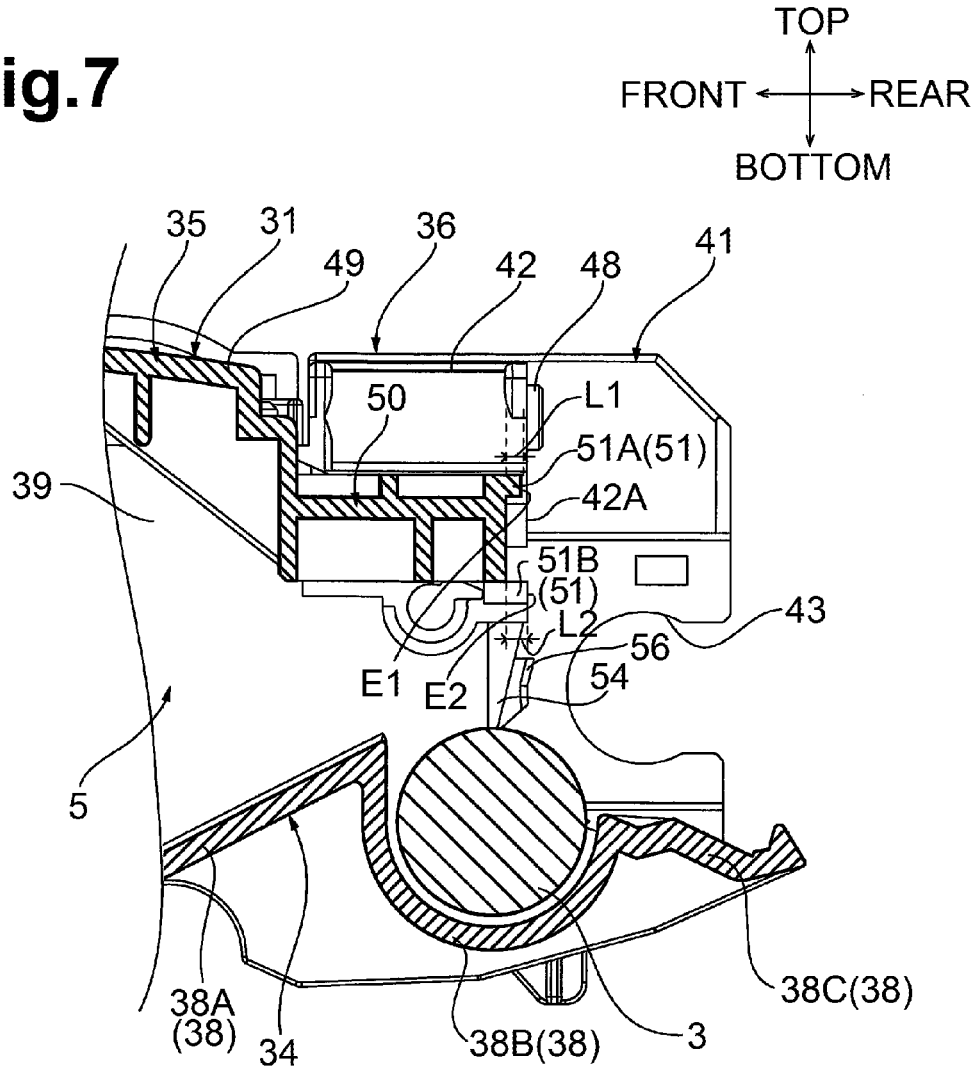
FIG. 7 is a sectional view of the developing cartridge depicted in FIG. 5.

Each rib 51 may be disposed at each end portion of the blade seal support portion 50 in the top-bottom direction, as depicted in FIGS. 6 and 7. The ribs 51 that may be disposed on an upper end portion of the blade seal support portion 50 may be hereinafter referred to as third regulating portions, e.g., upper ribs 51A. The ribs 51 that may be disposed on a lower end portion of the blade seal support portion 50 may be hereinafter referred to as fourth regulating portions, e.g., lower ribs 51B.

The upper ribs 51A may be disposed in line at upper end portions of the blade seal support portion 50 with a distance between the upper ribs 51A in the left-right direction. Each upper rib 51A may protrude rearward from the rear surface of the blade seal support portion 50, and may extend in the left-right direction. Each upper rib 51A may have a generally rectangular shape in rear view. A rear edge E1 of each upper rib 51A may be disposed in front of the rear surface 42A of the blade attachment portion 42 when viewed from the left-right direction.

The lower ribs 51B may be disposed in line at lower end portions of the blade seal support portion 50 with a distance between the lower ribs 51B in the left-right direction. One of the lower ribs 51B may be disposed at a generally central portion of the lower end portion of the blade seal support portion 50 in the left-right direction. One of the lower ribs 51B disposed at the generally central portion of the blade seal support portion 50 in the left-right direction may be an example of a first regulating portion and an inward regulating portion. Each lower rib 51B may protrude rearward from the rear surface of the blade seal support portion 50, and may extend in the left-right direction. Each lower rib 51B may have a generally rectangular shape in rear view. Each lower rib 51B may be positioned between a pair of the upper ribs 51A when viewed in the top-bottom direction. A rear edge E2 of each lower rib 51B may be disposed at almost the same position as the rear surface 42A of the blade attachment portion 42 in the front-rear direction when viewed from the left-right direction. A protruding amount L2 of each lower rib 51B may be greater than a protruding amount L1 of each upper rib 51A.

(1-2) Blade Seal and Side Seals

Figure 8:
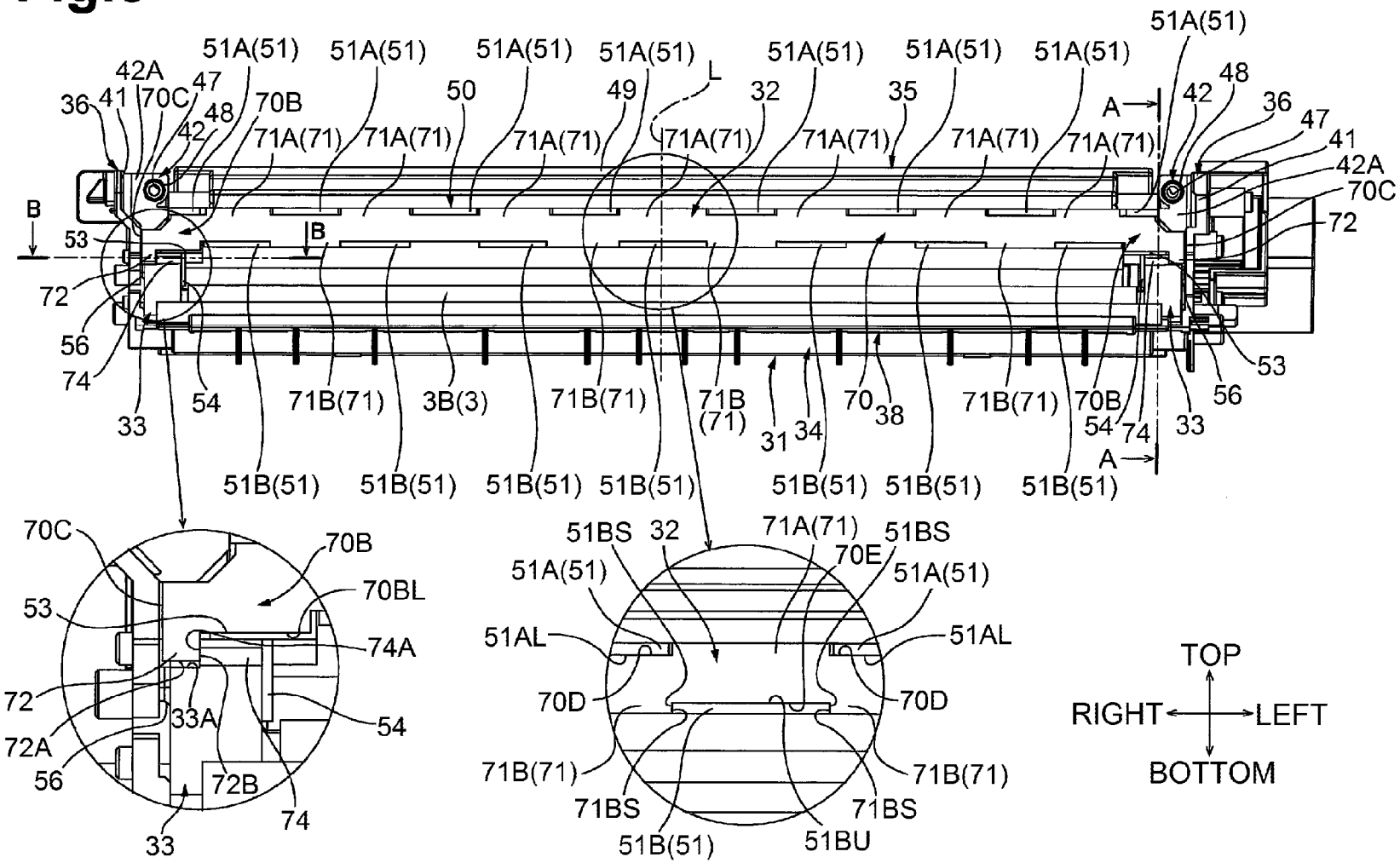
FIG. 8 is a rear view of the developing cartridge depicted in FIG. 4.
Figure 9B:
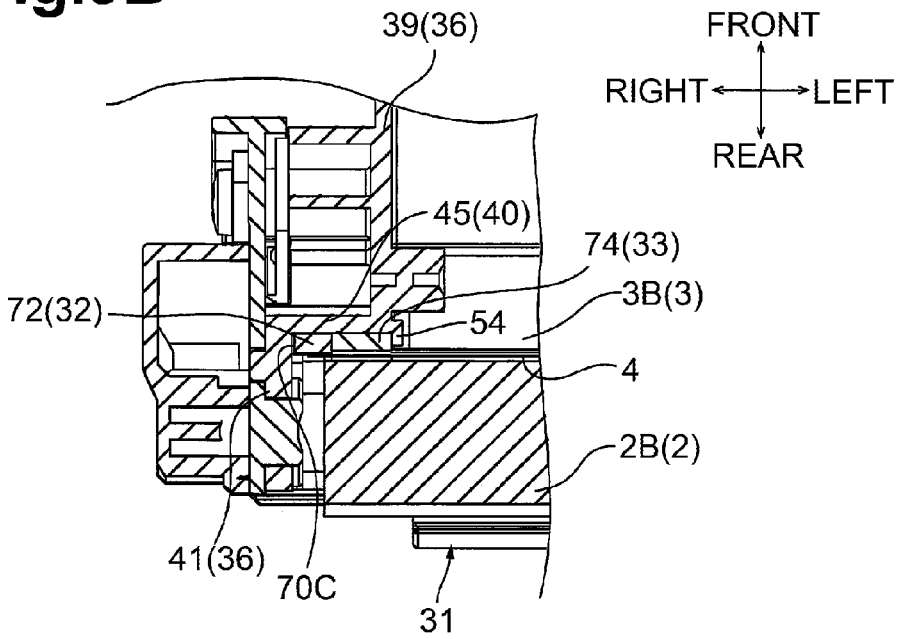
FIG. 9B is a sectional view of the developing cartridge taken along the line B-B of FIG. 8.

As depicted in FIGS. 8-9B, a portion of the blade seal 32 may be disposed between the rear surface of the blade seal support portion 50 of the cover frame 35 and the layer-thickness regulating blade 4. Other portion of the blade seal 32 may be disposed between the rear surface of the blade seal support portion 44 of the base frame 34 and the layer-thickness regulating blade 4. The portion of the front surface of the blade seal 32 may directly contact the rear surface of the blade seal support portion 50 of the cover frame 35, without an adhesive layer. The other portion of the front surface of the blade seal 32 may directly contact the rear surface of the blade seal support portion 44 of the base frame 34, without an adhesive layer. The rear surface of the blade seal 32 may directly contact the front surface of the layer-thickness regulating blade 4, without an adhesive layer. The blade seal 32 may comprise a resin sponge. The blade seal 32 may extend in the left-right direction and may have a generally prism shape. The blade seal 32 may be symmetrical with respect to an imaginary plane L passing through the center of the blade seal 32 in the left-right direction and extending in the top-bottom direction. The blade seal 32 may comprise a blade seal body 70, a plurality of extensions, e.g., protrusions 71, and a first protrusion, e.g., two engagement portions 72.

The blade seal body 70 may be disposed between the upper ribs 51A and the lower ribs 51B. In other words, an upper surface 70D of the blade seal body 70 may contact a lower surface 51AL of each upper rib 51A. A lower surface 70E of the blade seal body 70 may contact an upper surface 51BU of each lower rib 51B. The blade seal body 70 may have a generally prism shape. The blade seal body 70 may extend in the left-right direction. A front surface 70A of each left and right end portion of the blade seal body 70 may contact the rear surface of the blade seal support portion 44 of the base frame 34, as depicted in FIG. 9A. Each left and right end portion 70B of the blade seal body 70 may contact the upper surface of the first positioning portion 53 of the relevant side wall 36, as depicted in FIGS. 8 and 9A. More specifically, each left and right end portion 70B of the blade seal body 70 may have a lower surface 70BL substantially perpendicular to the top-bottom direction. The lower surface 70BL may contact the upper surface of the first positioning portion 53. Each left and right end face 70C of the blade seal body 70 may contact the inner surface of the developing roller attachment portion 41 of the relevant side wall 36 in the left-right direction, as depicted in FIGS. 8 and 9B. Each left and right end face 70C of the blade seal body 70 may be substantially perpendicular to the left-right direction.

Figure 5:
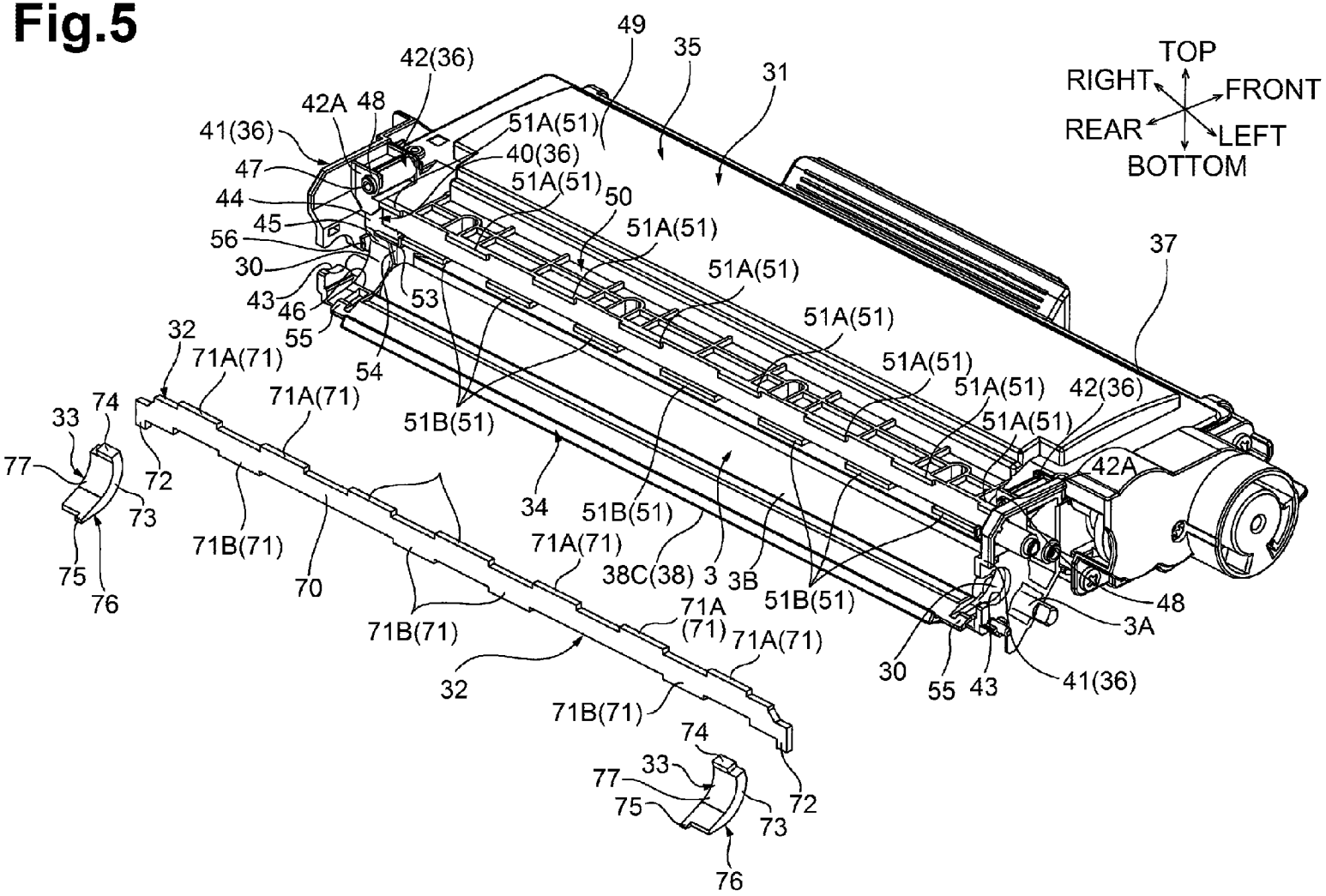
FIG. 5 is an exploded perspective view of the developing cartridge depicted in FIG. 4 viewed from an upper rear side thereof, in which a blade seal and a side seal of the developing cartridge are detached and the layer-thickness regulating blade is omitted in FIG. 5.

As depicted in FIGS. 5 and 8, each protrusion 71 may be disposed at each upper and lower end portion of the blade seal 32. The protrusions 71 that may be disposed at an upper end portion of the blade seal 32 may be hereinafter referred to as the upper protrusions 71A. The protrusions 71 may be disposed at a lower end portion of the blade seal 32 may be hereinafter referred to as the lower protrusions 71B.

The upper protrusions 71A may be disposed in line at an upper end portion of the blade seal 32 with a distance between the upper protrusions 71A in the left-right direction. Each upper protrusion 71A may protrude upward from an upper surface of the blade seal body 70 and may extend in the left-right direction. Each upper protrusion 71A may have a generally rectangular shape in rear view. Each upper protrusion 71A may be disposed between a pair of the upper ribs 51A. Each upper protrusion 71A may be slightly spaced apart from the upper ribs 51A disposed next to the upper protrusion 71A in the left-right direction when the blade seal 32 is set to the developing frame 31.

Each lower protrusion 71B may be disposed in line at a lower end portion of the blade seal 32 with a distance between the lower protrusions 71B in the left-right direction. More specifically, two lower protrusions 71B may be disposed at a generally central portion of the blade seal 32 in the left-right direction with a distance therebetween and one lower protrusion 71B may be disposed at each end portion of the blade seal 32 in the left-right direction. Each lower protrusion 71B may protrude downward from a lower surface of the blade seal body 70, and may extend in the left-right direction. Each lower protrusion 71B may have a generally rectangular shape in rear view. Each of the two lower protrusions 71B provided at a generally central portion of the blade seal 32 in the left-right direction may be disposed at each right and left side of the lower rib 51B provided at a generally central portion of the blade seal support portion 50 in the left-right direction. Each of the two lower protrusions 71B disposed at a generally central portion of the blade seal 32 in the left-right direction may contact respective end face of the lower rib 51B disposed at a generally central portion of the blade seal support portion 50 in the left-right direction. The interaction between an end of lower protrusion 71B and the end of rib 51B minimizes movement of blade seal 32. In one example, each end face 71BS of each lower protrusion 71B substantially perpendicular to the left-right direction may contact relevant end face 51BS of the lower rib 51B in the left-right direction. Each leftmost and rightmost lower protrusion 71B may be disposed between the corresponding two lower ribs 51B. It is appreciated that "substantially perpendicular" includes perpendicular orientations as well as orientations of the end faces other than perpendicular (e.g., acute or obtuse) with respect to the left-right direction. This non-parallel orientation of end face 71BS and/or end face 51BS with respect to the left-right direction may also minimize movement and are considered within the scope of this disclosure. In other words, movement may be minimized when each of end face 71BS and end face 51BS are not parallel with the left-right direction (though not necessarily parallel with each other). In another example, ends of the lower protrusion 71B may be shapes other than planar surfaces (i.e., other than planar surfaces 71BS).

Each engagement portion 72 may be disposed at each end portion of the blade seal 32 in the left-right direction outward of the leftmost and rightmost lower protrusion 71B in the left-right direction. Each engagement portion 72 may protrude downward from a lower surface of the blade seal body 70 such that each engagement portion 72 may be placed below the respective first positioning portion 53. Each engagement portion 72 may have a generally rectangular shape in rear view. Each engagement portion 72 may be disposed between the developing roller attachment portion 41 and the first positioning portion 53. A lower surface 72A of each engagement portion 72 may contact an upper surface 33A of the relevant side seal 33 at positions outward of a first engagement portion 74 (described below) in the left-right direction. The lower surfaces 72A of the engagement portions 72 of the blade seal 32 may be an example of a plurality of faces.

Each of the two side seals 33 may be disposed below each left and right end portion of the blade seal 32 between the side seal support portion 45 of each side wall 36 and each left and right end portion of the developing roller body 2. Each side seals 33 may directly contact the side seal support portion 45 of each the side wall 36 without an adhesive layer. Each side seal 33 may comprise a base layer 76 and a seal layer 77.

The base layer 76 may comprise sponge comprising resin, e.g., urethane resin, or elastomer, e.g., silicon rubber and natural rubber. The base layer 76 may be more flexible than the blade seal 32. The base layer 76 may comprise a base layer body 73, a second protrusion, e.g., a first engagement portion 74, and a second engagement portion 75.

The base layer body 73 may have a generally rectangular flat plate shape in rear view. The base layer body 73 may extend in the top-bottom direction, while curving, along the curvature of the side seal support portion 45. The dimension of the base layer body 73 in the left-right direction may be approximately the same as the dimension of the side seal support portion 45 in the left-right direction. A lower end portion of the base layer body 73 may contact a front end portion of the third positioning portion 55. An upper outer end portion of the base layer body 73 in the left-right direction may contact an inner surface of the fourth positioning portion 56 in the left-right direction.

The first engagement portion 74 may be disposed at an upper end portion of the base layer 76. The first engagement portion 74 may be positioned inward of the engagement portion 72 of the blade seal 32 in the left-right direction. The first engagement portion 74 may extend upward continuously from an upper inner end portion of the base layer body 73 in the left-right direction. The first engagement portion 74 may have a generally prism shape. An upper end portion of the first engagement portion 74 may contact the lower surface of the first positioning portion 53 of the side walls 36. An inner end portion of the first engagement portion 74 in the left-right direction may contact the outer surface of the second positioning portion 54 of the side walls 36 in the left-right direction. An outer surface 74A of the first engagement portion 74 in the left-right direction may contact an inner surface 72B of the engagement portion 72 of the blade seal 32 in the left-right direction. The inner surface 72B of the engagement portion 72 of the blade seal 32 in the left-right direction may be an example of a plurality of faces.

The second engagement portion 75 may be disposed at a lower end portion of the base layer 76. The second engagement portion 75 may extend downward continuously from a lower inner end portion of the base layer body 73 in the left-right direction. The second engagement portion 75 may have a generally prism shape. An outer end portion of the second engagement portion 75 in the left-right direction may face the inner surface of the third positioning portion 55 of the side walls 36 in the left-right direction.

The seal layer 77 may be adhered to the front surface of the base layer body 73. The seal layer 77 may have a shape similar to that of the base layer body 73. The seal layer 77 may comprise nonwoven fabric, or woven fabric, e.g., cashmere fiber, polytetrafluoroethylene fiber, and polyester fiber. The rear surface of the seal layer 77 may contact the peripheral surface of each left-right end portion of the developing roller body 2B.

(1-3) Layer-Thickness Regulating Blade

As depicted in FIGS. 1 and 4, the layer-thickness regulating blade 4 may comprise a first holding member 62, a second holding member 63, and a blade member 61.

The first holding member 62 may be disposed above the blade seal support portion 50 of the cover frame 35. The first holding member 62 may be elongated in the left-right direction. The first holding member 62 may have a generally L-shaped bent plate shape in sectional view. More specifically, a front portion of the first holding member 62 may extend in the front-rear direction. A rear portion of the first holding member 62 may bend downward at a rear end portion of the front portion of the first holding member 62. A front end portion of the first holding member 62 may face an upper end portion of the blade seal support portion 50. The first holding member 62 may comprise two fixing portions 64.

Each fixing portion 64 may protrude upward from each left and right end of the first holding member 62. Each fixing portion 64 may have a generally rectangular flat plate shape in front view. Each fixing portion 64 may have a through hole (not depicted) into which the boss 48 of the base frame 34 may fit. Each fixing portion 64 may contact the respective rear surface 42A of each blade attachment portion 42. Each fixing portion 64 may be fixed to the respective rear surface 42A of each blade attachment portion 42 of the base frame 34 with a screw 66 screwed into the screw hole 47 of the base frame 34.

The second holding member 63 may be disposed above the first holding member 62. The second holding member 63 may be elongated in the left-right direction. The second holding member 63 may have a generally L-shaped bent plate shape in sectional view. More specifically, a front portion of the second holding member 63 may extend in the front-rear direction above the first holding member 62. A rear portion of the second holding member 63 may bend downward at a rear end portion of the front portion of the second holding member 63, to face an upper end portion of the blade member 61 behind the blade member 61. The second holding member 63 may be fixed to the first holding member 62 with screws 65.

The blade member 61 may have a generally rectangular flat plate shape elongated in the left-right direction in front view. The blade member 61 may extend in the top-bottom direction. An upper end portion of the blade member 61 may be interposed between the rear portion of the first holding member 62 and the rear portion of the second holding member 63. A lower end portion of the blade member 61 may contact a front end portion of the developing roller 2.

(2) Attachment of Layer-Thickness Regulating Blade

An operator or worker may attach the layer-thickness regulating blade 4 to the developing frame 31 during the assembly of the developing cartridge 1, as depicted in FIGS. 4 and 5, in which the supply roller 3 may be already mounted to the developing frame 31.

First, the operator may attach the side seals 33 to the ride seal support portions 45 of the developing frame 31.

An upper end portion of the side seal 33 may contact the first positioning portion 53 of the side walls 36. A lower end portion of the side seal 33 may contact the third positioning portion 55 of the side wall 36. Thus, the movement of the side seal 33 between the first positioning portion 53 and the third positioning portion 55 in a rotation direction of the developing roller 2, e.g., a counterclockwise direction in left side view, may be restricted. The first engagement portion 74 of the side seal 33 may contact the second positioning portion 54 of the side wall 36 at an inner end portion thereof in the left-right direction.

Thereafter, the operator may attach the blade seal 32 to the blade seal support portion 50 of the cover frame 35 and the blade seal support portions 44 of the base frame 34.

At this time, the blade seal 32 may contact the rear surface of the blade seal support portion 50 of the cover frame 35 and the rear surface of the blade seal support portions 44 of the base frame 34 without an adhesive layer.

Therefore, the operator may adjust the position of the blade seal 32 relative to the blade seal support portion 50 while pressing the blade seal 32 against the blade seal support portion 50.

The blade seal 32 may be assembled to the blade seal support portion 50 of the cover frame 35 between the upper ribs 51A and the lower ribs 51B. The engagement portion 72 of the blade seal 32 may be disposed between the first engagement portion 74 of the side seal 33 and the developing roller attachment portion 41, in a compressed state. In other words, when the engagement portion 72 is not in the compressed state, a distance between the developing roller attachment portion 41 and the second positioning portion 54 in the left-right direction may be shorter than the sum of the length of the first engagement portion 74 of the side seal 33 in the left-right direction and the length of the engagement portion 72 of the blade seal 32 in the left-right direction.

The dimension of the blade seal 32 in the front-rear direction may be slightly longer than the protruding amount L2 of the lower ribs 51B, before the blade seal 32 is attached to the developing frame 31, as depicted in FIG. 7. More specifically, the protruding amount L2 of the lower ribs 51B may be appropriately a half (½) of the dimension of the blade seal 32 in the front-rear direction.

Thereafter, the operator may screw the layer-thickness regulating blade 4 to the blade attachment portions 42 of the developing frame 31.

As depicted in FIG. 1, an upper half portion of the blade seal 32 may be slightly compressed in the front-rear direction between the rear surface of the blade seal support portion 50 of the cover frame 35 and the first holding member 62 of the layer-thickness regulating blade 4 and between the rear surfaces of the blade seal support portions 44 of the base frame 34 and the first holding member 62 of the layer-thickness regulating blade 4.

At this time, the dimension of the upper half portion of the blade seal 32 in the front-rear direction may be almost the same as the protruding amount L2 of the lower ribs 51B.

A lower half portion of the blade seal 32 may deform to expand rearward as the upper half portion of the blade seal 32 is compressed. Therefore, the lower half portion of the blade seal 32 may be pressed against the front face of the blade member 61 of the layer-thickness regulating blade 4. Thus, the lower half portion of the blade seal 32 may make close contact with the blade member 61 of the layer-thickness regulating blade 4.

Thus, attachment of the layer-thickness regulating blade 4 to the developing frame 31 may complete.

4. Effects (1) In the developing cartridge 1, the position of the blade seal 32 may be fixed relative to the developing frame 31 in the left-right direction as the left and right ends of one of the lower ribs 51B provided at a generally central portion of the blade seal support portion 50 in the left-right direction may contact each of the two lower protrusions 71B disposed at a generally central portion of the blade seal 32, and each left and right end portion of the blade seal 32 may contact the respective the developing roller attachment portion 41 of the side wall 36, as depicted in FIG. 8.

Therefore, the blade seal 32 may be attached to the developing frame 31 without a member configured to fix the blade seal 32 to the developing frame 31.

Consequently, the blade seal 32 may be readily attached to the developing frame 31.

(2) In the developing cartridge 1, as depicted in FIG. 1, the blade seal 32 may directly contact the blade seal support portions 44 of the base frame 34, the blade seal support portion 50 of the cover frame 35 and the layer-thickness regulating blade 4 without adhesive material.

Therefore, the position of the blade seal 32 may be adjusted with the blade seal 32 contacting the blade seal support portion 44 and the blade seal support portion 50.

Consequently, the blade seal 32 may be attached to the developing frame 31 more readily.

(3) In the developing cartridge 1, the movement of a generally central portion of the blade seal 32 in the left-right direction may be restricted, as the left and right ends of one of the lower ribs 51B provided at a generally central portion of the blade seal support portion 50 in the left-right direction may contact each of the two lower protrusions 71B disposed at a generally central portion of the blade seal 32, as depicted in FIG. 8.

Therefore, a generally central portion of the blade seal 32 in the left-right direction may be reliably disposed between the blade seal support portion 50 of the cover frame 35 and the layer-thickness regulating blade 4.

(4) In the developing cartridge 1, the movement of the blade seal 32 in the top-bottom direction may be restricted by the upper ribs 51A and the lower ribs 51B, as depicted in FIG. 8.

Therefore, the position of the blade seal 32 may be fixed relative to the developing frame 31 more reliably.

(5) In the developing cartridge 1, the upper ribs 51A and the lower ribs 51B may interpose the blade seal 32 therebetween at each side of the blade seal 32 in the top-bottom direction, as depicted in FIG. 8.

Therefore, the movement of the blade seal 32 in the top-bottom direction may be restricted by the upper ribs 51A and the lower ribs 51B.

Consequently, the position of the blade seal 32 may be fixed relative to the developing frame 31 more reliably.

(6) In the developing cartridge 1, each protrusion 71 of the blade seal 32 may be disposed between the upper ribs 51A and between the lower ribs 51B, as depicted in FIG. 8. Thus, the blade seal 32 may be supported by the developing frame 31 more stably.

(7) In the developing cartridge 1, each upper rib 51A may be positioned between the lower ribs 51B when viewed from the top-bottom direction, as depicted in FIG. 8.

Therefore, the protrusions 71 of the blade seal 32 may be arranged alternately at upper portions and lower portions of the blade seal 32.

Thus, the length of the blade seal body 70 in the top-bottom direction may be constant across the blade seal body 70 in its left-right direction.

Consequently, the sealability or effectiveness of seal of the blade seal body 70 may be constant in its top-bottom direction.

(8) In the developing cartridge 1, as depicted in FIG. 8, the lower rib 51B provided at a generally central portion of the blade seal support portion 50 in the left-right direction may contact the two lower protrusions 71B at a generally central portion of the blade seal 32 in the left-right direction. Each upper rib 51A may be disposed between the upper protrusions 71A, to provide a space therebetween in the left-right direction or to separate from the respective upper protrusions 71A in the left-right direction.

Therefore, the movement of the blade seal 32 in the left-right direction may be restricted at the lower rib 51B provided at a generally central portion of the blade seal support portion 50. Further, dimensional errors of the blade seal 32 may be absorbed in the upper ribs 51A.

Consequently, ease of attachment of the blade seal 32 to the developing frame 31 may be improved while accuracy of positioning the blade seal 32 relative to the developing frame 31 is ensured.

(9) In the developing cartridge 1, the protruding amount L2 of the lower rib 51B may be greater than or equal to the protruding amount L1 of the upper rib 51A, as depicted in FIG. 7.

Therefore, when the blade seal 32 is attached to the developing frame 31, the blade seal 32 may be prevented from coming off or slipping off downward.

Consequently, the blade seal 32 may be readily attached to the developing frame 31.

(10) In the developing cartridge 1, as depicted in FIG. 7, the protruding amount L2 of the lower rib 51B may be approximately a half of the dimension of the blade seal 32 in the front-rear direction.

Therefore, when the blade seal 32 is attached to the developing frame 31, the blade seal 32 may further be prevented or reduced from coming off or slipping off downward.

(11) In the developing cartridge 1, as depicted in FIG. 7, the rear edge E1 of each upper rib 51A may be positioned in front of the rear surface 42A of the blade attachment portion 42.

Therefore, the layer-thickness regulating blade 4 supported by the blade attachment portion 42 may be prevented or reduced from interfering with the ribs 51.

(12) In the developing cartridge 1, the movement of each left and right end portion of the blade seal 32 may be restricted by the contact between each end portion of the blade seal 32 in the left-right direction and the respective developing roller attachment portion 41 of each side wall 36, as depicted in FIG. 8.

Therefore, each left and right end portion of the blade seal 32 may be reliably positioned between the blade seal support portion 44 of the base frame 34 and the layer-thickness regulating blade 4.

(13) In the developing cartridge 1, each end portion of the blade seal body 70 in the left-right direction may contact the upper surface of the respective first positioning portion 53 of each side wall 36, as depicted in FIG. 8. An upper end portion of the first engagement portion 74 of each side seal 33 may contact the lower surface of the respective first positioning portion 53 of each side wall 36.

Therefore, the blade seal 32 and the side seals 33 may be positioned relative to the first positioning portions 53.

Consequently, the arrangement of the blade seal 32 relative to the side seal 33 may be ensured.

(14) In the developing cartridge 1, the side seal 33 may directly contact the side seal support portion 45, without an adhesive material.

Therefore, the side seal 33 may be readily attached to the side seal support portion 45.

(15) In the developing cartridge 1, the developing roller attachment portion 41 and the second positioning portion 54 may interpose the engagement portion 72 of the blade seal 32 and the first engagement portion 74 of the side seal 33 therebetween, as depicted in FIG. 8.

Therefore, the engagement portion 72 of the blade seal 32 and the first engagement portion 74 of the side seal 33 may be make reliable contact with each other. Thus, the sealability or effectiveness of seal between the engagement portion 72 of the blade seal 32 and the first engagement portion 74 of the side seal 33 may be ensured.

(16) In the developing cartridge 1, distance between the developing roller attachment portion 41 and the second positioning portion 54 may be shorter than the sum of the length of the engagement portion 72 of the blade seal 32 in the left-right direction and the length of the first engagement portion 74 of the side seal 33 in the left-right direction.

Therefore, the engagement portion 72 of the blade seal 32 and the first engagement portion 74 of the side seal 33 may be compressed between the developing roller attachment portion 41 and the second positioning portion 54, as depicted in FIG. 8.

Consequently, the sealability or effectiveness of seal between the blade seal 32 and the side seal 33 may further be ensured.

(17) In the developing cartridge 1, the blade seal 32 may be more flexible than the side seal 33.

Therefore, the engagement portion 72 of the blade seal 32 may be compressed between the developing roller attachment portion 41 and the first engagement portion 74 of the side seal 33, as depicted in FIG. 8.

Consequently, the sealability or effectiveness of seal between the blade seal 32 and the side seal 33 may further be ensured while twist of the side seal 33 may be prevented or reduced.

(18) In the developing cartridge 1, the first engagement portion 74 of the side seal 33 may contact the second positioning portion 54, as depicted in FIG. 8.

Therefore, the first engagement portion 74 of the side seal 33 may be positioned in the left-right direction more reliably.

(19) In the developing cartridge 1, the engagement portion 72 of the blade seal 32 may contact the side seal 33 at a lower end portion and an inner end portion of the engagement portion 72 in the left-right direction, as depicted in FIG. 8.

Therefore, the sealability or effectiveness of seal between the blade seal 32 and the side seal 33 may further be ensured.

(20) In the developing cartridge 1, the blade seal 32 may be symmetrical with respect to an imaginary plane L passing through the center of the blade seal 32 in the left-right direction and extending in the top-bottom direction, as depicted in FIG. 8.

Therefore, the blade seal 32 may be attached to the developing frame 31, even when the blade seal 32 may be flipped horizontally.

Consequently, the blade seal 32 may be attached to the developing frame 31 more readily.

Figure 10:
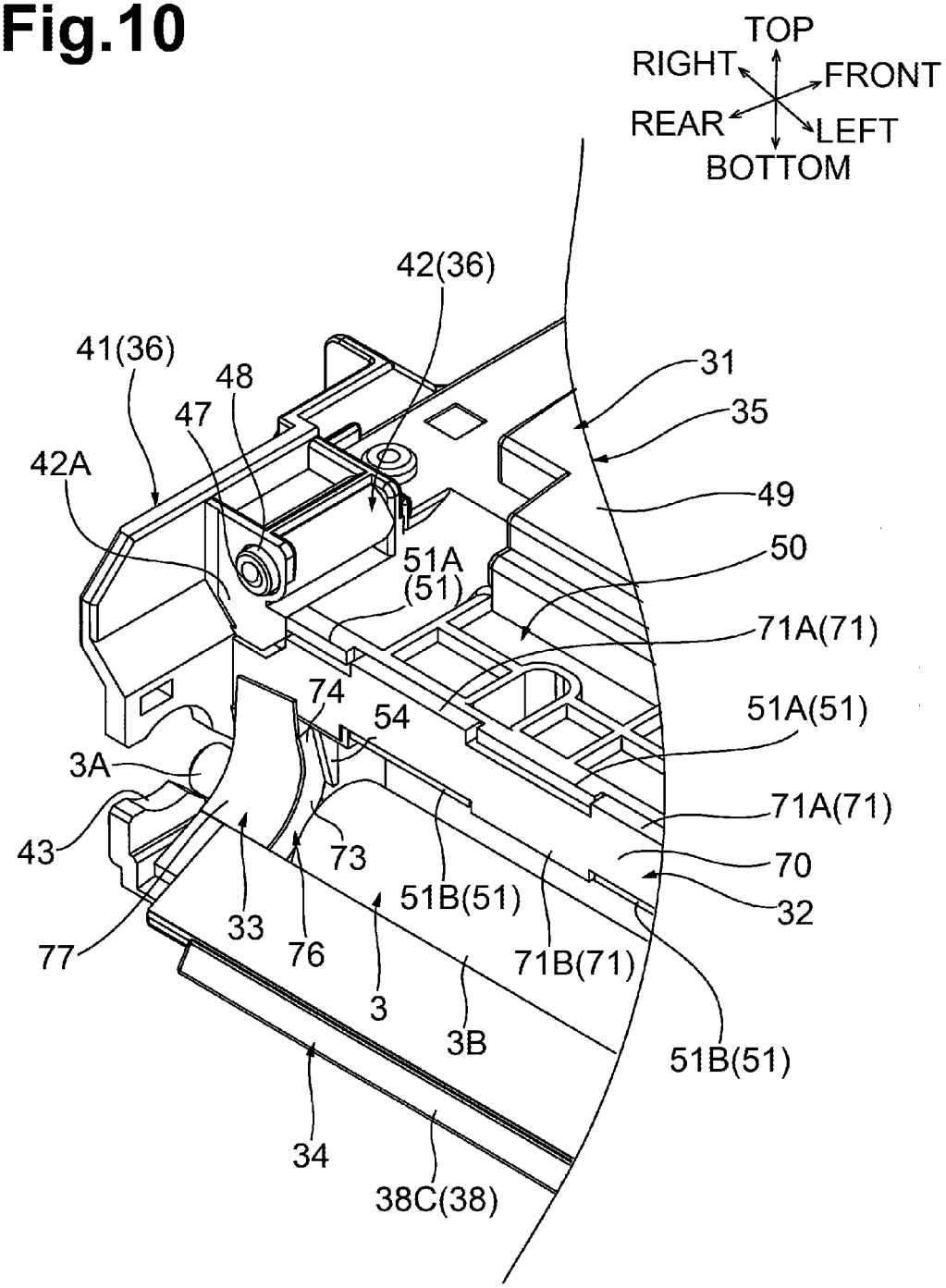
FIG. 10 is a partially perspective view of a developing cartridge according to a modification of the illustrative embodiment.

5. Modifications (1) As depicted in FIG. 10, the seal layer 77 of the side seal 33 may be configured to extend above an upper end portion of the base layer 76. The extended portion of the seal layer 77 may be disposed over the first positioning portion 53 of the side wall 36 and the rear surface of each left and right end portion of the blade seal 32.

In the modification, the seal layer 77 may cover the boundary between the side seal 33 and the blade seal 32.

Therefore, entry of the toner into the boundary between the side seal 33 and the blade seal 32 may be prevented or reduced.

A contact portion between the blade seal 32 and the first positioning portion 53 and a contact portion between the side seal 33 and the first positioning portion 53 may be covered with the seal layer 77.

Figure 11:
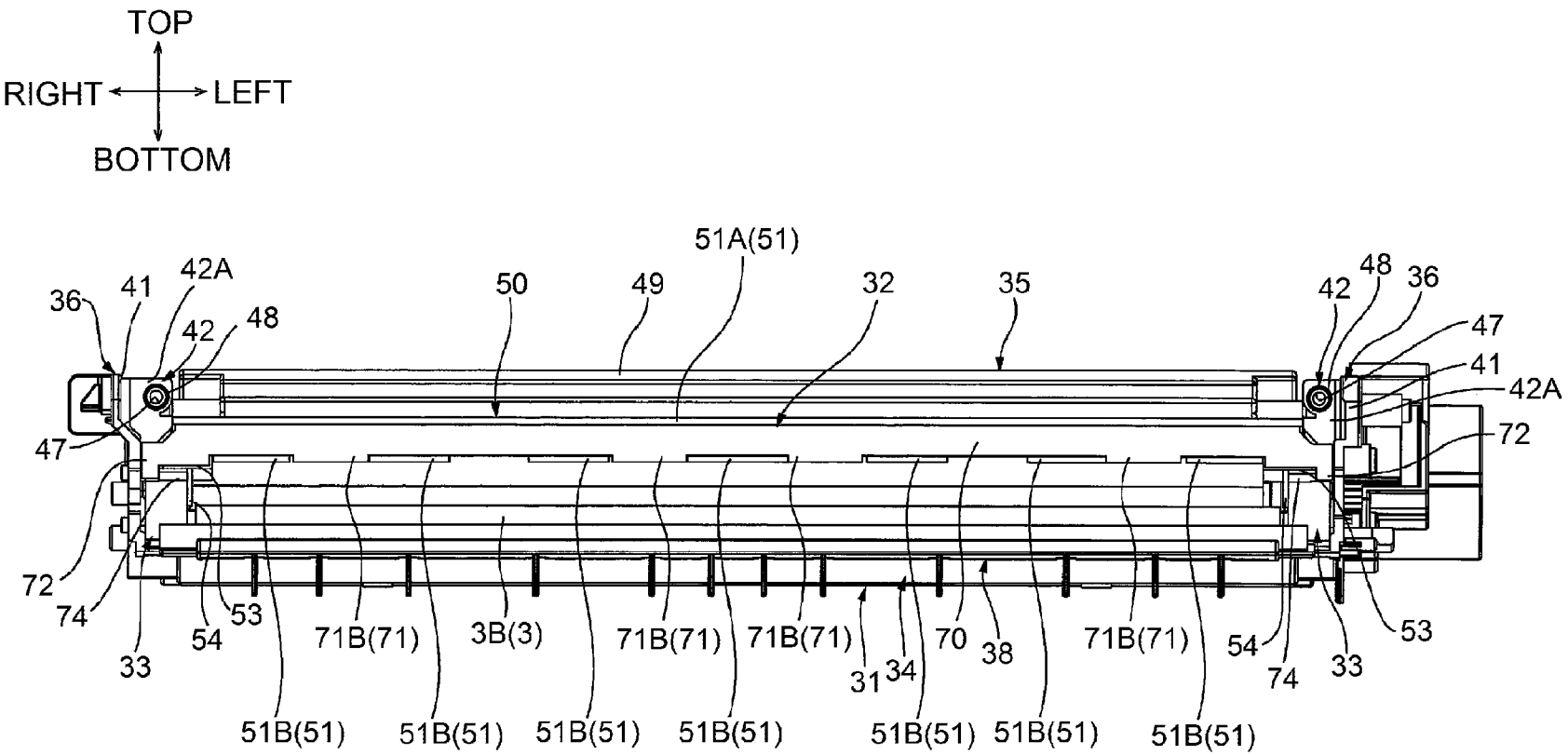
FIG. 11 is a rear view of a developing cartridge according to another modification of the illustrative embodiment.

(2) As depicted in FIG. 11, the upper ribs 51A may be configured to continuously extend in the left-right direction. Thus, the upper rib 51A may be simply structured. The blade seal 32 may be attached to the blade seal support portions 44 and the blade seal support portion 50 more readily.

(3) In the above-described illustrative embodiment, the blade seal 32 may be structured not to have, for example, the upper protrusions 71A.

(4) In the above-described illustrative embodiment, a magnetic roller may be used in place of the developing roller 2.

(5) In the above-described illustrative embodiment, the process cartridge 13 may be structured to integrally provide a developing unit comprising the developing roller 2 and a drum unit comprising the photosensitive drum 21.

(6) In the above-described illustrative embodiment, the blade seal 32 may be structured such that each surface of at least one of the lower protrusions 71B in the left-right direction may be disposed between the lower ribs 51B of the blade seal support portion 50.

(7) In the above-described illustrative embodiment, each left and right end portion of the blade seal 32 may contact an inner surface of the respective developing roller attachment portion 41 in the left-right direction. A structure to position the blade seal 32 in the left-right direction might not be particularly limited. For example, each of the left and right blade seal support portions 44 may comprise a rib that may protrude rearward from the rear surface thereof. The rib may be configured to contact each left and right end portion of the blade seal 32.

While the disclosure has been described in detail with reference to the specific embodiment thereof, this is merely an example, and various changes, arrangements and modifications may be applied therein without departing from the spirit and scope of the disclosure.

What is claimed is:

1. A developing device comprising:

a casing configured to store a developing agent;

a developing agent carrier configured to carry the developing agent in the casing, the developing agent carrier configured to rotate about an axis extending in a first direction;

a layer-thickness regulating member configured to regulate a thickness of a layer of the developing agent carried on the developing agent carrier; and a first seal member disposed between the layer-thickness regulating member and the casing and is disposed to oppose the layer-thickness regulating member in a second direction perpendicular to the first direction, the first seal member extending along the first direction and including a first end and a second end and including an upper side and lower side, wherein the casing includes a first regulating portion configured to regulate a movement of the first seal member in the first direction by contacting the first end of the first seal member that is non-parallel with respect to the first direction and the casing including a second regulating portion configured to regulate a movement of the first seal member in the first direction by contacting the second end of the first seal member that is non-parallel with respect to the first direction, wherein the casing includes a plurality of third regulating portions spaced from each other configured to regulate a movement of the first seal member in a third direction perpendicular to the second direction and the first direction, and wherein the third regulating portions contact the upper side of the first seal member, wherein the plurality of third regulating portions are formed with upper ribs spaced from each other in the first direction, and wherein the first seal member includes a plurality of upper protrusions protruding in the third direction and each of the upper protrusions is disposed between a pair of the upper ribs.

2. The developing device according to claim 1, wherein the first seal member directly contacts the casing and the layer-thickness regulating member without an adhesive material.

3. The developing device according to claim 1, wherein each of the third regulating portions include an inward regulating portion disposed inward of each end portion of the first seal member in the first direction.

4. The developing device according to claim 1, wherein the casing includes a plurality of fourth regulating portions spaced from each other and configured to regulate a movement of the first seal member in the third direction perpendicular to the second direction and the first direction, and wherein the fourth regulating portions contact the lower side of the first seal member, wherein the plurality of fourth regulating portions that contact the lower side of the first seal member are formed with lower ribs spaced from each other in the first direction, and wherein the first seal member includes a plurality of lower protrusions protruding in the third direction and each of the lower protrusions is disposed between a pair of the lower ribs.

5. The developing device according to claim 4, wherein the first seal member includes an extension extending toward one side of the third direction or an opposite side of the third direction such that the extension is disposed between the third regulating portions or between the fourth regulating portions.

6. The developing device according to claim 5, wherein one of a group of the fourth regulating portions and a group of the third regulating portions contacts a respective group of the four protrusions or third protrusions in the first direction, and wherein the other one of the group of the fourth regulating portions and the group of the third regulating portions is separated from the respective group of fourth protrusions or third protrusions in the first direction.

7. The developing device according to claim 4, wherein each of the third regulating portions is disposed between a pair of the fourth regulating portions when viewed from the third direction.

8. The developing device according to claim 4, wherein at least one of the third regulating portion and the fourth regulating portion continuously extends in the first direction.

9. The developing device according to claim 4, wherein the casing includes a first support portion supporting the first seal member, wherein the third regulating portion and the fourth regulating portion protrude from the first support portion in the second direction, and wherein a protruding amount of the fourth regulating portion is greater than or equal to a protruding amount of the third regulating portion.

10. The developing device according to claim 4, wherein the casing includes a first support portion supporting the first seal member, wherein the fourth regulating portion protrudes from the first support portion in the second direction, and wherein a protruding amount of the fourth regulating portion is greater than a half of a length of the first seal member in the second direction and shorter than the length of the first seal member in the second direction.

11. The developing device according to claim 1, wherein the casing includes a support portion supporting the layer-thickness regulating member and protruding from each end portion of the casing in the first direction toward an opposite side of the second direction to one side of the second direction, wherein the second regulating portion protrudes from the one side of the second direction to the opposite side of the second direction, and wherein an end portion of the second regulating portion on the opposite side of the second direction is disposed closer to the one side of the second direction than an end portion of the support portion on the opposite side of the second direction.

12. The developing device according to claim 1, wherein the first seal member includes end portions, and wherein each of the first regulating portion and the second regulating portion includes an outward regulating portion disposed outward of each end portion of the first seal member in the first direction.

13. The developing device according to claim 12, further comprising a second seal member disposed between an end portion of the developing agent carrier in the first direction and the casing, wherein the first seal member and the second seal member are disposed adjacent to each other in a rotation direction of the developing agent carrier, wherein the casing includes a first positioning portion protruding in a second direction perpendicular to the first direction, and the first positioning portion is configured to regulate a movement of the second seal member in the rotation direction by contacting a downstream end portion of the second seal member in the rotation direction, and wherein the first positioning portion contacts the first seal member in the rotation direction.

14. The developing device according to claim 13, wherein the second seal member directly contacts the casing without an adhesive material.

15. The developing device according to claim 13, wherein an end portion of the first seal member in the first direction includes a first protrusion protruding toward the second seal member, wherein the second seal member includes a second protrusion protruding toward the first seal member, wherein the first protrusion and the second protrusion overlap with each other when projected in the first direction, wherein the casing includes a second positioning portion disposed inward of the outward regulating portion in the first direction with a distance therebetween, the second positioning portion positions the second seal member relative to the first direction, and wherein the first protrusion and the second protrusion are disposed between the outward regulating portion and the second positioning portion when projected in the first direction.

16. The developing device according to claim 15, wherein a distance between the outward regulating portion and the second positioning portion is shorter than a sum of a length of the first protrusion in the first direction and a length of the second protrusion in in the first direction.

17. The developing device according to claim 15, wherein the first seal member is more flexible than the second seal member, and wherein the first protrusion contacts the outward regulating portion.

18. The developing device according to claim 17, wherein the second protrusion contacts the second positioning portion.

19. The developing device according to claim 15, wherein the first seal member contacts the second seal member at a plurality of faces thereof.

20. The developing device according to claim 13, wherein the second seal member includes a base layer and a seal layer laminated on the base layer, and wherein the seal layer overlaps with the first seal member.

21. The developing device according to claim 20, wherein the seal layer overlaps with the first positioning portion.

22. The developing device according to claim 1, wherein the first seal member is symmetrical with respect to an imaginary plane passing through a center of the first seal member in the first direction and extending in a third direction perpendicular to the first direction.

23. The developing device according to claim 1, wherein the first regulating portion contacts a surface of the first seal member perpendicular to the first direction.

24. The developing device according to claim 1, wherein the first regulating portion is a surface extending in the first direction.

25. A developing device comprising:

a casing configured to store a developing agent, the casing including a first attachment portion and a second attachment portion, an inward-facing surface of the first attachment portion being separated from an inward-facing surface of the second attachment portion by a distance;

a developing agent carrier configured to carry the developing agent in the casing, the developing agent carrier configured to rotate about an axis extending in a first direction, the developing agent carrier being positioned between the first attachment portion and the second attachment portion;

a layer-thickness regulating member configured to regulate a thickness of a layer of the developing agent carried on the developing agent carrier; and a first seal member disposed between the layer-thickness regulating member and the casing and is disposed to oppose the layer-thickness regulating member in a second direction perpendicular to the first direction, the first seal member extending along the first direction and directly contacting each of the first attachment portion and the second attachment portion, the first seal member including an upper side and a lower side, and the first seal member having an uncompressed length at least as long as the distance between the inward-facing surfaces of the first attachment portion and the second attachment portion, wherein the casing includes a plurality of third regulating portions spaced from each other configured to regulate a movement of the first seal member in a third direction perpendicular to the second direction and the first direction, and wherein the third regulating portions contact the upper side of the first seal member, wherein the plurality of third regulating portions are formed with upper ribs spaced from each other in the first direction, and wherein the first seal member includes a plurality of upper protrusions protruding in the third direction and each of the upper protrusions is disposed between a pair of the upper ribs.

26. The developing device according to claim 25, wherein the first seal member directly contacts the casing and the layer-thickness regulating member without an adhesive material.

27. A developing device comprising:

a casing configured to store a developing agent, the casing including a first attachment portion and a second attachment portion;

a developing agent carrier configured to carry the developing agent in the casing, the developing agent carrier configured to rotate about an axis extending in a first direction, the developing agent carrier being positioned between the first attachment portion and the second attachment portion;

a layer-thickness regulating member configured to regulate a thickness of a layer of the developing agent carried on the developing agent carrier; and a first seal member disposed between the layer-thickness regulating member and the casing and is disposed to oppose the layer-thickness regulating member in a second direction perpendicular to the first direction, the first seal member extending along the first direction, the first seal member including an upper side and a lower side, and the first seal member directly contacting at least one of the first attachment portion and the second attachment portion, wherein the casing includes a plurality of third regulating portions spaced from each other configured to regulate a movement of the first seal member in a third direction perpendicular to the second direction and the first direction, and wherein the third regulating portions contact the upper side of the first seal member, wherein the plurality of third regulating portions are formed with upper ribs spaced from each other in the first direction, and wherein the first seal member includes a plurality of upper protrusions protruding in the third direction and each of the upper protrusions is disposed between a pair of the upper ribs.

28. The developing device according to claim 27, wherein the first seal member directly contacts the casing and the layer-thickness regulating member without an adhesive material.

29. A developing device comprising:

a casing configured to store a developing agent, the casing including a first attachment portion and a second attachment portion spaced from each other in a first direction, the casing including a first seal support portion extending in the first direction and having a height direction, and a seal regulating portion having at least two sides of which at least one side is spaced from each of the first attachment portion and the second attachment portion;

a developing agent carrier configured to carry the developing agent in the casing, the developing agent carrier configured to rotate about an axis extending in the first direction, the developing agent carrier being positioned between the first attachment portion and the second attachment portion;

a layer-thickness regulating member configured to regulate a thickness of a layer of the developing agent carried on the developing agent carrier; and a first seal member disposed between the layer-thickness regulating member and the first seal support portion of the casing and is disposed to oppose the layer-thickness regulating member in a second direction perpendicular to the first direction, the first seal member including a protrusion extending in the height direction and including an upper side and a lower side, the protrusion configured to contact at least one of the sides of the seal regulating portion to reduce movement of the first seal member relative to the first seal support portion, wherein seal regulating portions spaced from each other configured to regulate a movement of the first seal member in a third direction perpendicular to the second direction and the first direction, and wherein the seal regulating portions contact the upper side of the first seal member, wherein the plurality of seal regulating portions are formed with upper ribs spaced from each other in the first direction, and wherein the first seal member includes a plurality of upper protrusions protruding in the third direction and each of the upper protrusions is disposed between a pair of the upper ribs.

30. The developing device according to claim 29, wherein another of the seal regulating portion or the protrusion is on another side of the protrusion or the seal regulating portion, respectively.

31. The developing device according to claim 29, further comprising:

another seal regulating portion having at least one side, wherein the side of the another seal regulating portion is configured to contact the protrusion at a location separate from the side of the seal regulating portion.

32. The developing device according to claim 29, further comprising:

another protrusion, wherein the seal regulating portion has a second side spaced from each of the first attachment portion and the second attachment portion, and wherein the another protrusion is configured to contact the second side of the seal regulating portion.

33. The developing device according to claim 29, wherein the first seal member directly contacts the casing and the layer-thickness regulating member without an adhesive material.

34. The developing device according to claim 29, wherein the seal regulating portion is configured to contact the first seal member to minimize movement in a second direction, the second direction being perpendicular to the first direction.

35. The developing device according to claim 34, wherein the protrusion of the first seal member is located on a portion of a first side of the first seal member, wherein the seal regulating portion is a first seal regulating portion, wherein the casing includes a second seal regulating portion positioned to contact at least a portion of a second side of the first seal member, such that the second seal regulating portion and the first seal regulating portion minimize movement of the first seal member in the second direction.

36. The developing device according to claim 35, wherein the first portion of the first seal member overlaps in the second direction at least the portion of the second side of the first seal member.

37. The developing device according to claim 35, wherein the first portion of the first seal member does not overlap in the second direction at least the portion of the second side of the first seal member.

38. The developing device according to claim 35, wherein the casing includes at least two first seal regulating portions, and wherein the second seal regulating portion is positioned between the at least two first seal regulating portions in the second direction.

39. The developing device according to claim 35, wherein the first seal member includes a plurality of protrusions on both the first side of the first seal member and on the second side of the first seal member, and wherein the casing includes a plurality of first seal regulating portions and a plurality of second seal regulating portions, wherein one of the plurality of first seal regulating portions and the plurality of second seal regulating portions is configured to contact the sides of the protrusions in the first direction on a respective side of the first seal member while the other of the plurality of first seal regulating portions and the plurality of second seal regulating portions is spaced from the sides of the protrusions in the first direction on the respective side of the first seal member.

40. The developing device according to claim 34, wherein the protrusion of the first seal member is located on a portion of a first side of the first seal member, and wherein the first seal member includes a second protrusion on a second side of the first seal member and the second protrusion is continuous along the second side of the first seal member.

* * * * *